US005474374A

United States Patent [19]

Sandvig

[11] Patent Number: 5,474,374

[45] Date of Patent: Dec. 12, 1995

[54] CABINET-MOUNTED SLIDING TRAY

[76] Inventor: Dennis L. Sandvig, 842 E. Douglas Ave., Bellingham, Wash. 98226

[21] Appl. No.: 306,261

[22] Filed: Sep. 14, 1994

[51] Int. Cl.[6] ..... A47B 77/10

[52] U.S. Cl. ..... 312/274; 312/271

[58] Field of Search ..... 312/271, 273, 312/274, 275, 276

[56] References Cited

U.S. PATENT DOCUMENTS

| | | | |
|---|---|---|---|
| 364,479 | 6/1887 | Childs . | |
| 815,263 | 3/1906 | Buckwalter | 312/274 |
| 1,227,813 | 5/1917 | Mahoney | 312/274 |
| 1,899,171 | 2/1933 | Warren . | |
| 2,247,232 | 6/1941 | Goldberg . | |
| 2,530,336 | 11/1950 | Marini . | |
| 3,184,276 | 5/1965 | Billups . | |
| 3,323,852 | 6/1967 | Meyers | 312/319 |
| 3,425,765 | 2/1969 | Levy | 312/274 |
| 4,639,050 | 1/1987 | Neuhaus | 312/273 |

FOREIGN PATENT DOCUMENTS

| | | | |
|---|---|---|---|
| 197830 | 8/1938 | Switzerland . | |
| 249608 | 4/1948 | Switzerland . | |
| 0674685 | 6/1952 | United Kingdom | 312/274 |

*Primary Examiner*—Kenneth J. Dorner
*Assistant Examiner*—Anthony Barfield
*Attorney, Agent, or Firm*—Todd N. Hathaway

[57] ABSTRACT

A sliding tray assembly for mounting in a kitchen cabinet or the like. The edges of the tray panel are received in guide channels, and a drawbar is attached to the cabinet door to automatically slide the tray in and out. The forward end of the panel is radiused off at one corner to clear the inside of the door, and the bracket for mounting the rearward end of the drawbar to the panel is configured to allow the panel to be inverted for left- or right-hand installations. The bracket also provides a backstop for retaining articles on the tray panel.

16 Claims, 4 Drawing Sheets

CABINET-MOUNTED SLIDING TRAY

FIELD OF THE INVENTION

The present invention relates generally to cabinets and drawers, and, more particularly, to a sliding tray which is mounted in a cabinet so as to automatically extend therefrom in response to opening of the cabinet door.

BACKGROUND ART

It is common practice to place waste pails and similar containers in cabinets, particularly under kitchen and bathroom sinks and counters. However, this arrangement requires a person to lean down and reach into the cabinet in order to reach the container, which is not only inconvenient but often leads to spillage in an area which is difficult to clean. Moreover, the necessary bending motions are often difficult or impossible for elderly or physically disabled persons to perform.

A number of devices have been proposed in attempt to deal with this problem, none having been met with particular success. Of the known prior art systems, perhaps that which has come the closest to providing a viable solution is that described in U.S. Pat. No. 3,425,765 to Levy. Owing to its relevance to the present invention, this device will be described in detail with reference to FIG. 2. As can be seen, the Levy device 10 consists of a generally rectangular panel 12 which is mounted to the floor of a cabinet 14 in channel-shaped edge rails 16*a*,16*b*. A pull bar 18 is pivotally mounted to the middle of the panel at 20 and to the cabinet door at 22. Thus, as the door is opened, the bar pulls the panel out of the cabinet, so that the container positioned in the area indicated by broken line image 24 where it is easier for the person to gain access.

The device which has been described in the preceding paragraph enjoys the advantage of relative simplicity, but exhibits a number of deficiencies in use. The first and perhaps most serious is illustrated in FIG. 3A. As can be seen, interference between the relatively square corners 26*a*, 26*b* at the front of the tray 12 and the inside of the cabinet door limits the extension of the tray. As a result, when the cabinet door is opened, as shown in FIG. 3A, the container 24 is only partially withdrawn from beneath the counter top, severely hindering access. In the Levy device, the problem is aggravated by the use of a relatively short arm 18 which is attached near the middle of the tray; as the cabinet door opens beyond about the 90° position, the bar begins the pull laterally, rather than longitudinally, with the result that the tray will not continue to move outwardly from the cabinet and may jam in position when the person tries to close the door. Moreover, because the interference between the corner of the tray and the door necessitates generally central positioning of the device if there is to be any significant extension of the tray at all, a gap 25 is formed between the edge rail 16*b* and the inside wall of the cabinet which tends to collect dirt and garbage in a difficult to clean area.

A second deficiency which stems from attaching the drawbar near the middle of the tray is that this is in the area 24 which is intended to be occupied by the waste container. As a result, the top surface of this area must be kept free of protrusions also that the container can slide freely during removal and replacement. This means that the pivot point 20 is provided by a screw (see FIG. 2 of the Levy patent) which is supported at one end only by the relatively thin material of the shelf. This (in combination with the increased stresses which result from the lateral pulling of the bar) results in a serious weak point, where the pivot screw is very likely to pull out of the bottom of the tray panel with extended use. Another weak point is the L-bracket which the Levy device uses to attach the opposite end of the drawbar to the cabinet door, inasmuch as tension forces placed on the drawbar result in a prying moment which tends to pull the mounting screws out of the door.

Furthermore, the Levy device exhibits deficiencies in economy of manufacture. For example, in order to provide the desired spacing between the channel tracks, the device requires a central foundation panel (see 14 in FIG. 2 of the Levy patent) which represents a significant and wasteful expenditure of material. Also, the channel tracks and other members, and the manner in which these are assembled, are not suited for economical fabrication.

As part of the present invention, the Applicant has identified the sources of the problems discussed above, and has provided an improved cabinet-mounted sliding tray assembly which has solved the same.

SUMMARY OF THE INVENTION

The present invention has solved the problems cited above, and is a sliding tray assembly which is configured to be mounted in a cabinet having an outwardly opening door, the tray assembly comprising:

(a) a tray panel having parallel side edges and a forward end with a first, relatively square corner, and a second, rounded off corner which is configured to clear the inside of the cabinet door, (b) first and second channel members having guide slots for receiving the edges of the panel, (c) a door bracket member which is mountable to the inside of the cabinet door, (d) an elongate drawbar having a forward end which is pivotally mounted to the door bracket member and a rearward end, and (e) a combination backstop and pivot attachment member mounted to the rearward end of the tray panel, the combination member comprising: a channel portion having upper and lower walls which define a horizontal slot for retaining the rearward edge of the tray panel, upper and lower flange portions which extend outwardly from the walls so as to form upper and lower backstops along the rearward edge of the panel, upper and lower receptacle portions formed in the walls of the channel portion and extending outwardly from the horizontal slot so as to form upper and lower pockets adjacent the panel for receiving the rearward end of the drawbar, the upper and lower pockets being arranged in vertical alignment on opposite sides of the horizontal slot, so that the tray panel is alternately mountable in first and second positions in which, respectively, the rounded off corner thereof clears a cabinet door which opens in right-handed and left-handed directions, by inverting the panel to a selected position and installing the second end of the drawbar in a selected one of the pockets which is on the lower side of the panel in the selected position, and a pivot pin which extends vertically through the receptacle portions and the end of the drawbar which is received therein so as to pivotally connect the drawbar and the rearward edge of the tray panel, so that the drawbar extends beneath the tray panel and slides the panel in and out of the cabinet through the channel members in response to opening and closing of the cabinet door.

Preferably, the door bracket comprises a horizontally extending plate portion for mounting to the inside of the cabinet door, and an outwardly extending tongue portion having a pivot attachment for the forward end of the drawbar. The door bracket member preferably comprises first and second mounting screw bores from proximate the ends of the horizontally extending plate portion, the pivot attachment on the tongue portion being positioned in horizontal alignment between the bores so as to eliminate development of prying moments against the mounting screws and so as to minimize vertical spacing between the drawbar and the mounting screws so that the latter will be positioned to penetrate the frame portion of a panelled door.

The pivot attachment in the door bracket may comprise a vertically extending boss which forms a hub for rotation of the forward end of the drawbar about a vertical axis, the boss having a cylindrical outer bearing surface for engaging a corresponding bore in the end of the drawbar. Preferably, the boss is formed of material which provides a relatively slick bearing surface, such as molded nylon.

The combination backstop and pivot attachment member may be formed of a generally rigid plastic material, with attachment areas being formed proximate first and second ends thereof for mounting to the rearward edge of the tray panel by nailing. Preferably, each attachment area comprises a blister area formed in the wall of the channel portion, so that the wall bows outwardly from the horizontal slot so as to form a cavity intermediate the tray panel and the wall, the cavity being sized to accommodate deformation of the plastic material and panel which results from the nailing, without causing the walls of the channel portion to spread away from the tray panel.

Each channel member may comprise (a) parallel, horizontally extending, upper and lower wall portions, (b) a vertically extending sidewall portion which joins the upper and lower wall portions along a first edge thereof, (c) a vertically extending middle wall portion joining the upper and lower wall portions along a middle portion thereof, so that a hollow core of the channel member is formed on the first side of the middle wall portion and a horizontally extending channel is formed on an opposite side thereof intermediate outwardly extending edges of the upper and lower wall portions, and (d) a divider wall portion which extends horizontally from a middle portion of the middle wall portion so as to divide the channel into first and second guide slots, the divider wall portion having a depending flange portion which extends perpendicularly from a side thereof, so that the upper horizontal wall portion and the divider wall define a first guide slot having a first width, and the lower horizontal wall portion and an end of the depending flange portion define a second guide slot having a second width, The wall portions of the channel member are preferably of equal in width so as to facilitate manufacture of the channel member by an extrusion moulding process.

DETAILED DESCRIPTION a. Overview

Figure 1:
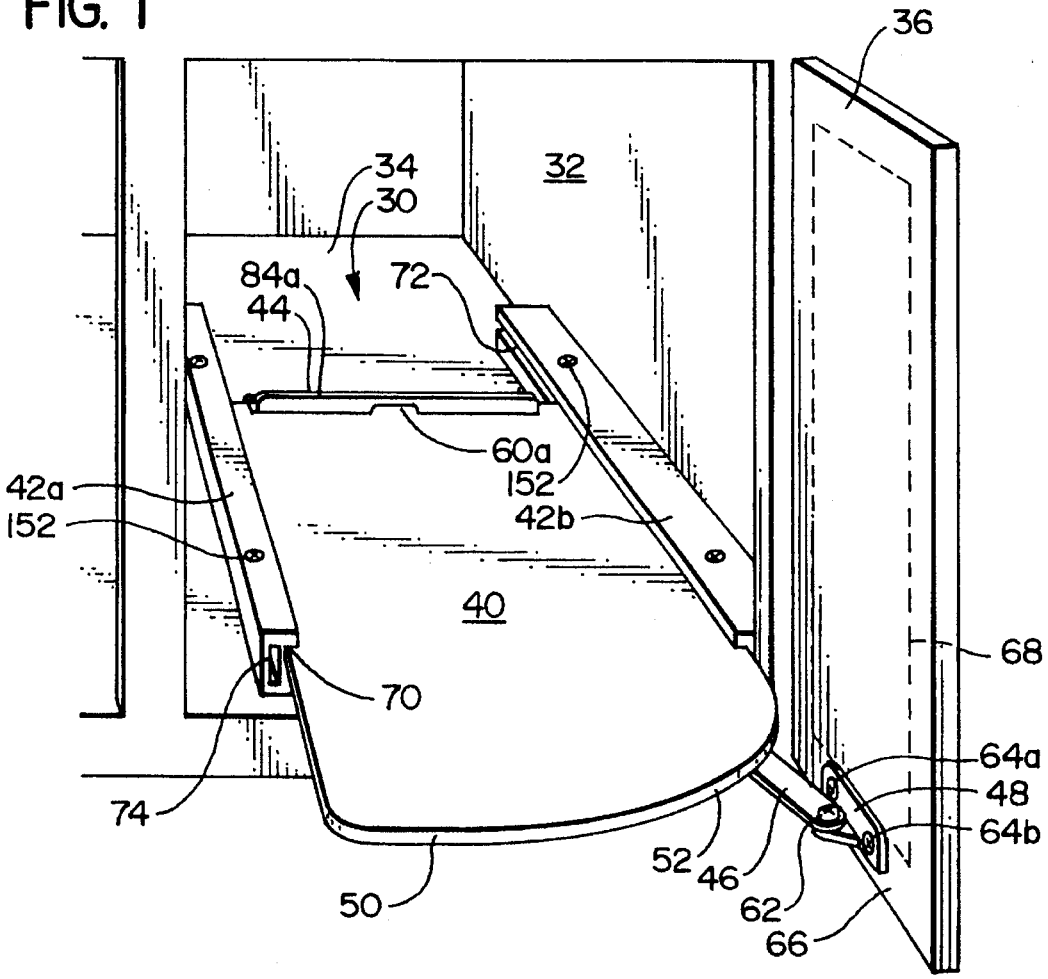
FIG. 1 is a perspective view of a sliding tray assembly in accordance with the present invention mounted for operation in a conventional cabinet.
Figure 2:
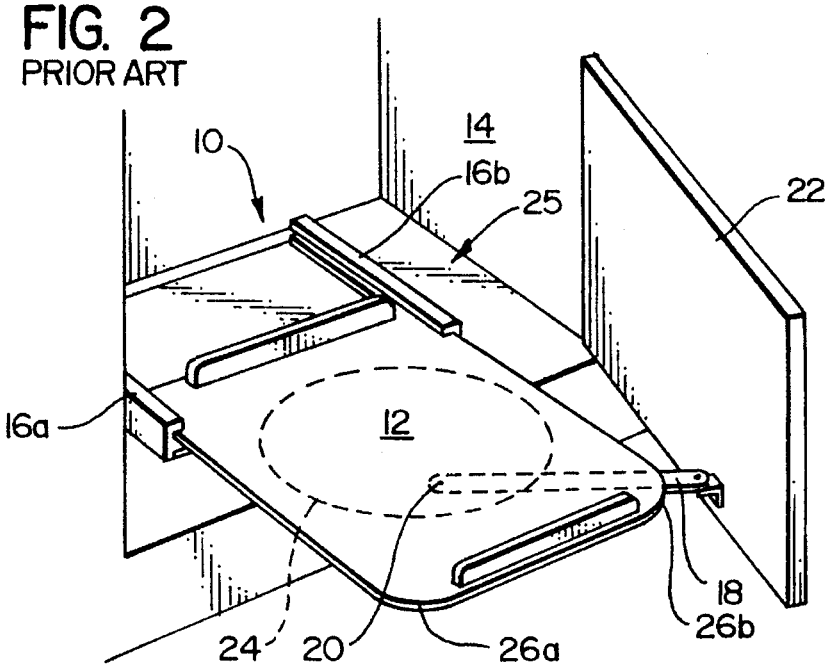
FIG. 2 PRIOR ART
FIG. 2 is a perspective view of the prior art sliding tray assembly which is described in the Background section of the Specification.

FIG. 1 provides a perspective view of the sliding tray assembly 30 in accordance with the present invention mounted inside a cabinet 32, such as, for example, an under-counter cabinet in a kitchen or bathroom. As is conventional, the cabinet is provided with a floor 34 and a hinged door 36.

The central component of the sliding tray assembly 30 is the tray panel 40. The edges of the panel are received for longitudinal sliding movement in left and right channel members 42*a*, 42*b*. A combined backstop and pivot mount-bracket 44 is mounted to the rear edge of the tray panel, and the rearward end of an elongate drawbar 46 is pivotally attached to this. The forward end of the drawbar is pivotally attached to a door bracket 48 which mounts to the inside of the cabinet door.

Inasmuch as the improvements and advantages which are provided by the present invention stem from the features and relationships of the components which have been listed in the preceding paragraph, each of these will be described in detail below. However, an overview of the improved function which results therefrom will be provided here.

Figure 3A:
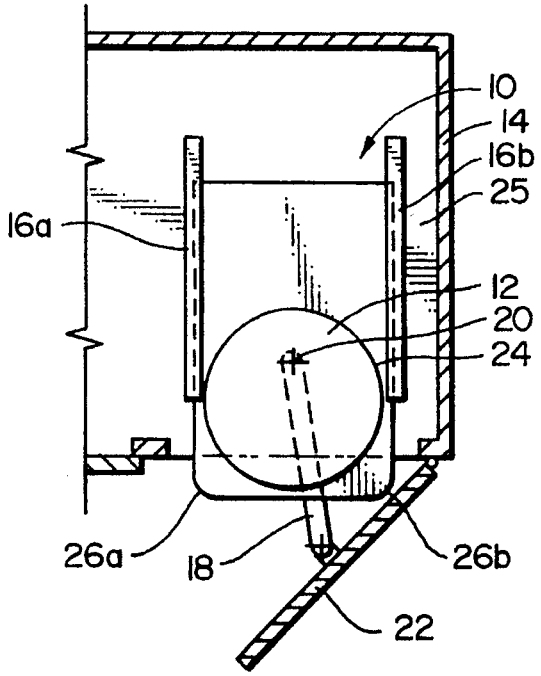
FIG. 3A PRIOR ART
FIG. 3A is a top plan view showing the extension of the prior art sliding tray assembly of FIG. 2.
Figure 3C:
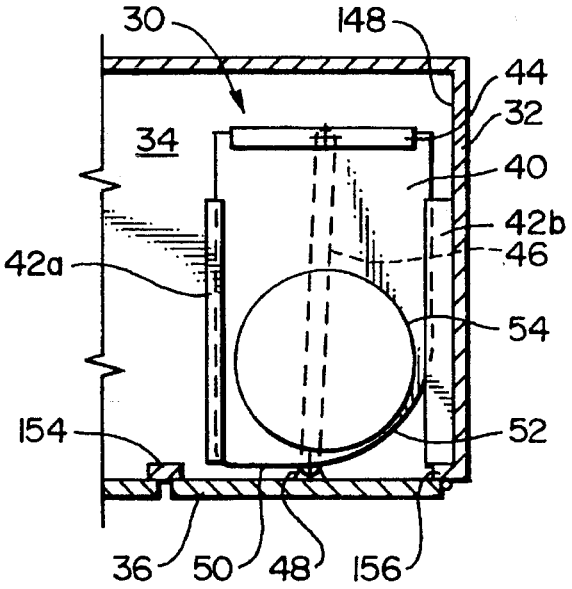
FIG. 3C is a view similar to FIG. 3B, showing the assembly with the door in the closed position.
Figure 3B:
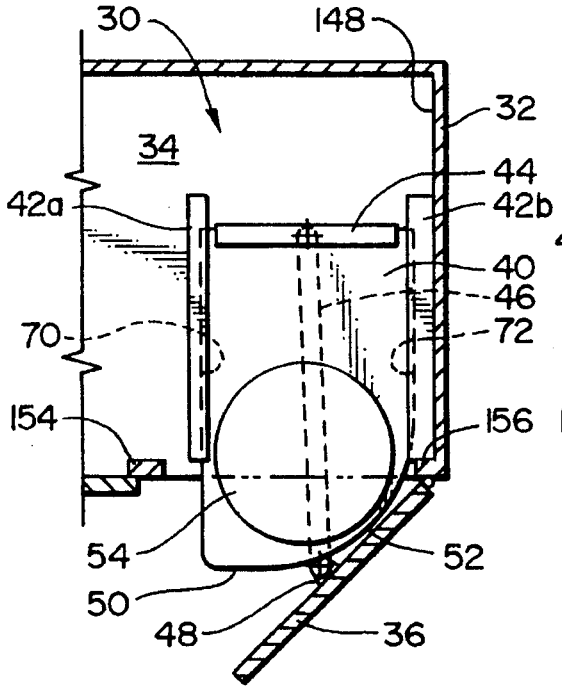
FIG. 3B is a view similar to FIG. 3A, showing the extension of the sliding tray assembly of the present invention with the door open at an angle which corresponds to that shown in FIG. 3A.

As can be seen in FIG. 1 the forward edge 50 of the tray panel is provided with a cutaway, radiused corner 52 which extends closely adjacent to the inner surface of the cabinet door. As is shown in FIG. 3B, this enables a full-width tray panel to extend much further from beneath the cabinet top, providing much improved access to the waste container 54. However, the angled corner is provided on one side of the panel only, since providing angled portions on both sides (as indicated by dotted line image 56) would mean that the forward edge of the panel would draw to a point, resulting in insufficient space to position a large waste container in this area.

Although the tray panel 40 of the present invention is thus distinctly asymmetrical in form, its novel configuration permits the same assembly to be used for both left-hand and right-hand installations. As will be described in greater detail below, the combined backstop/pivot bracket 44 is provided with "mirror image" upper and lower receptacle portions 60*a*, 60*b* which are configured to receive the rearward end of the drawbar 46, thus permitting the panel 40 to be inverted for either right- or left-hand installation. Also, by providing a mounting point for the drawbar which is positioned right at the rearward end of the sliding panel, the angle of the drawbar relative to the centerline of the panel is reduced, permitting greater extension of the panel and smoother operation.

The forward end of the drawbar 46, is mounted to the door bracket 48 by a hub assembly and an attachment screw 62. As will also be described in greater detail below, this provides a pivot point which is positioned in alignment between first and second mounting screws 64*a*, 64*b* at the ends of the bracket. Amongst other advantages, this configuration eliminates any prying moment which would tend to pull the screws out of the door, and ensures that the screws will be positioned where they will engage the relatively thicker edge moulding 66 of a paneled cabinet door, rather than projecting through the thinner central panel thereof, as indicated by broken line image 68.

Finally, as will also be discussed below, the channel members 42 are provided with first and second guide slots 70, 72 which are sized to received tray panels 40 of two different, standardized thicknesses. The channel members are formed with a hollow core 74, so that the wall thickness of the structure is uniform throughout; this greatly facilitates the manufacture of the channel members through an extrusion moulding process. Moreover, the wall thickness is sized so as to provide a shallow vertical gap between panel 40 and the floor 34 of the cabinet which is sized to receive the drawbar 46 for movement therein. Also, as will be described below, the present invention has eliminated the need for a foundation plate such as that which is included in the Levy device to provide the correct spacing between the two channel members.

Different sizes which have been found suitable for tray panel 40 are 9½ inches wide by 15 inches long and 14 inches wide by 19 inches long.

b. Combined Backstop/Pivot Bracket

Figure 4A:
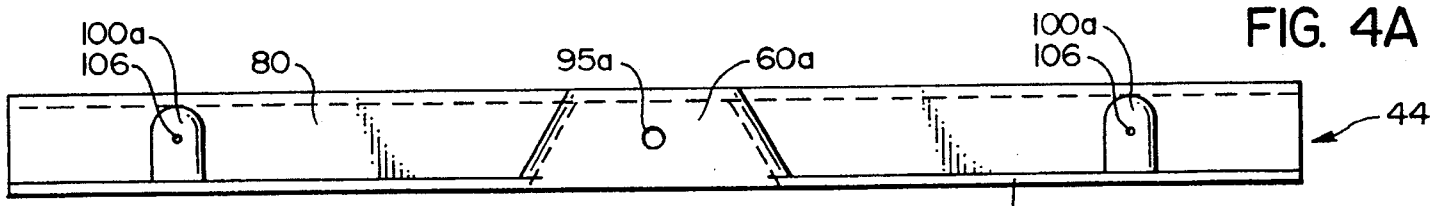
FIG. 4A is a plan view of the combined backstop and pivot attachment member of the tray assembly of FIG. 1.
Figure 4B:
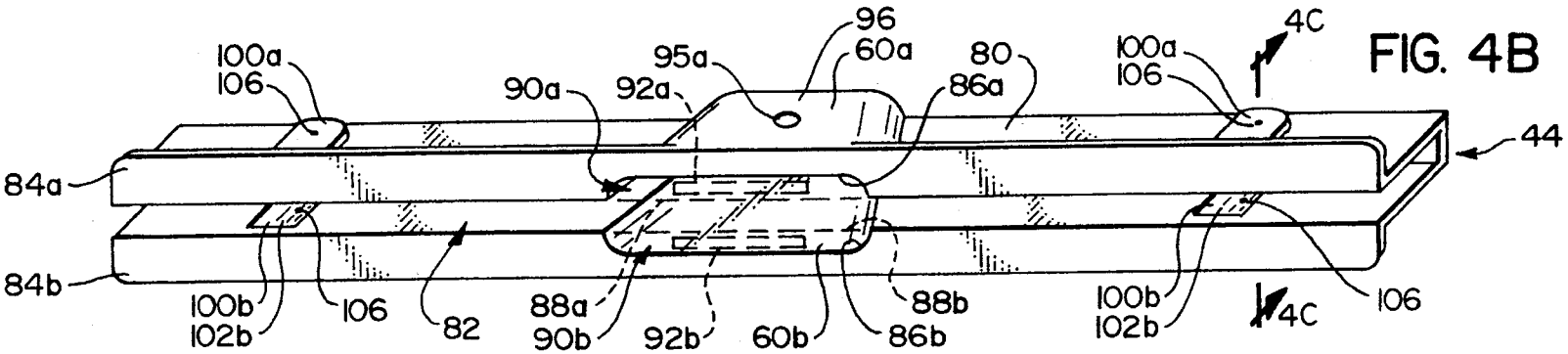
FIG. 4B is a perspective view of the combined backstop and pivot attachment bracket of FIG. 4A, illustrating the manner in which the end of the drawbar is receivable in first and second positions as the tray panel is inverted.

FIG. 4A shows a plan view of the combined backstop/rear pivot bracket 44. The bracket member is provided with an elongate channel portion 80 which is sized to receive the rear edge of the main panel 40 in a close fit therewith. For example, a channel portion 80 having a length of approximately 8.5 inches and a width of approximately 0.75 inch, and defining a receiving slot 82 of approximately 0.25 inch (see FIG. 4B) has been found to be eminently suitable for use with a ¼ inch thick tray panel which is sized to fit within a standard undersink cabinet.

Upper and lower flange portions 84*a*, 84*b* extend perpendicularly from the walls of the channel portion adjacent to the mouth thereof. As can be seen in FIG. 1, that flange portion which is arranged upwardly in a particular installation provides a backstop which prevents the waste container and other items which are stored on the shelf from sliding off of the tray panel. Flange portions having a height of approximately ⅜ inch have been found eminently suitable.

As was noted above, bracket 44 also includes centrally located upper and lower receptacle portions 60*a*, 60*b* which provide the rear attachment point for drawbar 46. The interior of each socket portion has a hollowed out portion 86*a*, 86*b* which extends away from the plane of the tray panel, as is indicated by broken line images 88*a*, 88*b*, so as to define cavities 90*a*, 90*b* which are sized to receive the rearward end of the drawbar 46, as indicated by broken line images 92*a*, 92*b*; for example, when using ⅛ inch stock for the drawbar, a cavity having a height of approximately 3/16 inch has been found suitable.

Figure 5:
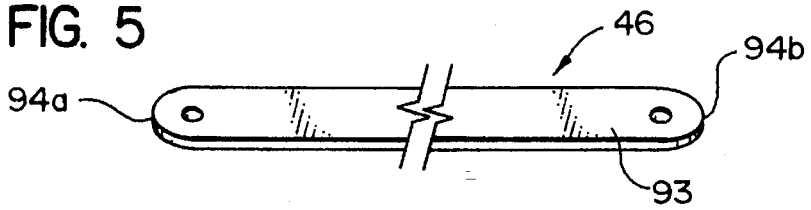
FIG. 5 is a perspective view of the drawbar member of the tray assembly of FIG. 1.

As for the drawbar 46 itself, this is suitably formed of a length of metal (e.g., aluminum) flat bar stock 93 as shown in FIG. 5, and is preferably provided with radiused ends 94*a*, 94*b* which avoid interference with the end brackets during pivoting movement.

Once received in the cavity, the end of the drawbar is secured for pivoting movement by a pivot pin (e.g., a 3/16" dia. ×1" long steel pin, which provides excellent wear characteristics in combination with an aluminum drawbar) which is driven through an opening 95*a* in the top wall 96 of the receptacle, and through corresponding bores in the drawbar (see FIG. 5), tray panel, and opposite receptacle 60*b*.

This construction provides a very firm and durable pivot mount for the end of the drawbar, with the pivot pin being supported at both ends by the walls of the upper and lower receptacles, as well as by the corresponding bore in the tray panel. Moreover, this arrangement is key to the invertibility of the panel, and therefore to the adaptability of the assembly to use in both right-hand and left-hand installations. For example, the backstop/pivot bracket permits the tray panel 40 to be mounted for a right-hand door installation, so that its angled corner 52 extends as shown in FIG. 3B, with the end of the drawbar being received in the lower cavity 90*b* in the position indicated by 92*b*. For a left-hand door installation, in turn, the panel is inverted or "flipped over" so that its angled edge 52 extends in the position indicated by broken line image 56 in FIG. 3B; the end of the drawbar is then received in the other cavity 90*a* in the position indicated by 92*a* in FIG. 4B, this being on the bottom of the panel in the inverted, left-handed position.

The backstop/pivot bracket 44 which is shown is particularly adapted for economical manufacture from injection moulded plastic, such as high density polyethylene (HDPE), with a ⅛ inch wall thickness having been found to be suitable.

The bracket 44 formed of HDPE or other plastic is provided with upper and lower, transversely-extending blister structures 100*a*, 100*b* near the first and second ends thereof. As can be seen in FIG. 4C, the blister structures 100*a*, 100*b* are vertically aligned on opposite sides of the receiving slot 82 and the concave inner surfaces thereof form semi-cylindrical cavities 102*a*, 102*b* which extend adjacent to the surfaces of the tray panel. The corresponding, generally convex outer surfaces of the blister structures, in turn, ensure constant wall thickness in this area for strength and moulding purposes.

In construction of the assembly, the tray panel 40 is inserted in the receiving slot 82 as is shown in FIG. 4C. Nails or pins 104 (e.g., ⅝" slight-head nails) are then driven through the blister structures and the panel, penetrating at the points which are indicated by dots 106 in FIG. 4B. In order to facilitate production, it has been found suitable to install the pins by means of an air gun or pneumatic nailer. As the nail is thus driven or "blown" through the bracket and panel, the force of its passage causes the plastic material of these members to distort as is shown in FIG. 4C: The material tends to "mushroom" around the entry points, as indicated, for example, at 108 in FIG. 4C, and tends to stretch out and peak around the exit points, as shown at 110. Thus, if the walls of the channel member were to lie flush against the tray panel in this area, these deformities would tend to spread the members apart, resulting in a lack of fit and poor aesthetics and durability. However, in the present invention it has been discovered that by providing the blister structures at the nailing points, the cavities 102 form spaces which accommodate these deformities without resulting in bending of the adjacent wall structures. This results in a much tighter fitting, more durable structure. In the embodiment which is illustrated, using HDPE material for member 44, blister structures providing 1/32-inch recesses on either side of the tray panel have been found suitable.

Figure 4D:
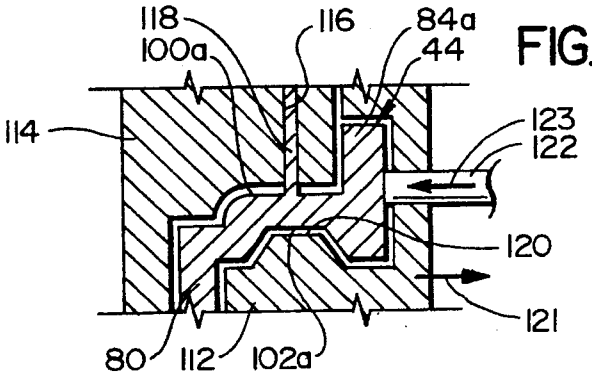
FIG. 4D is a sectional view of an upper portion of the bracket member of FIGS. 4A–4C, illustrating the manner in which the blister structures thereof aid in the production of the bracket member in an injection-moulding process.
Figure 4C:
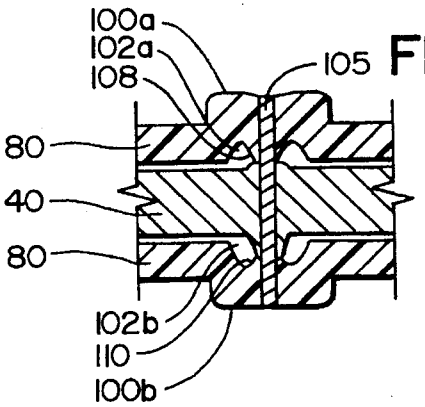
FIG. 4C is a sectional view taken along line 4C—4C in FIG. 4B, showing the manner in which blister structures at the ends of the member accommodate deformation of the materials which result from nailing so as to prevent the walls and panel from being spread.

Another important advantage which is provided by the blister structures 100 is illustrated in FIG. 4D. As was noted above, for reasons of both economy and strength, member 44 is preferably an injection-moulded piece. Thus, FIG. 4 is a fragmentary view of this article being formed between male and female mould members 112, 114. As is conventional in injection moulding, the liquid plastic material (e.g., HDPE) is injected into the cavity between the mould members, through one or more passages 116. The mould members are then separated and the article is removed. A difficulty which is encountered, however, is that the waste sprue 118 which is left in the injection passage tends to "hang up" in the female mould. In the present invention this problem has been solved by forming the blister cavities 102 as "closed-ended" indentations, so that the corresponding protrusions 120 on the male mould member engage these areas in the manner of teeth engaging sockets. Thus, as the mould members are separated, the male member pulls the plastic bracket 44 out of the female cavity in the direction indicated by arrow 121, cleanly shearing the sprue 118 off at the base. Ejector pins 122 or similar means are then used to apply force against the upstanding flange portion 84 in the direction indicated by arrow 123 in order to free the article from the male mould member; as this is done, the upper and lower walls of the channel portion 80 (now being outside the female mould) spread apart as they ride up and over ramped surfaces formed on the ends of the mould protrusions 120.

c. Door Bracket

FIGS. 5A–5C illustrate the structure of the bracket 48 which serves to mount the forward end of the drawbar to the cabinet door.

Figure 6A:
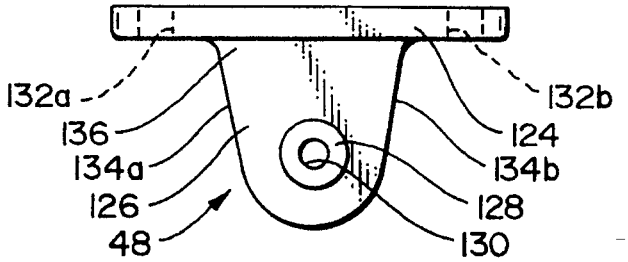
FIG. 6A is a plan view of the door bracket of the assembly shown in FIG. 1.

As can be seen in FIG. 6A, the door bracket is provided with a mounting plate portion 124 which is configured to lie flush against the inside of the cabinet door, and an outwardly protruding tongue portion 126 from which a hub boss 128 extends in a vertical direction. The boss is provided with a cylindrical outer surface which is received in a corresponding bore formed in the end of the drawbar, and is also provided with an internal bore 130 which is sized to receive a screw 62 (see FIG. 1) having a head which is sufficiently large to retain the end of the draw rod on the boss. The overall height (i.e., thickness) of the tongue portion is selected to fit in the space between the tray panel and the cabinet floor, thus permitting a closer fit between the tray edge and the door and a consequent greater extension of the tray, as may be seen in FIGS. 3B and 3C.

Thus assembled, the boss provides a smoothworking bearing surface and very durable attachment point for the end of the metal draw rod; this construction is far superior to a plain stud attachment such as that used in the prior art device described above, in terms of satisfactory operation and service life, as well as ease of manufacture. To further enhance durability and to provide a superior bearing surface, this member is preferably fabricated of slick-surfaced molded nylon.

Figure 6B:
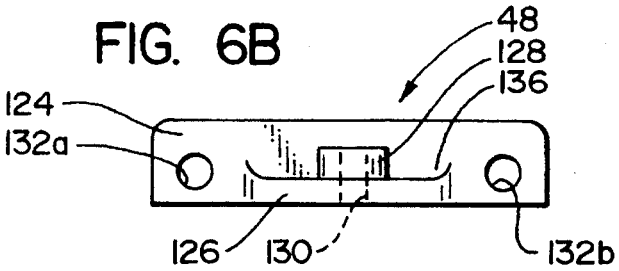
FIG. 6B is an elevational view of the bracket of FIG. 6A, showing the pivot hub which supports the end of the draw rod and the manner in which this is positioned in alignment between the bracket mounting screws.
Figure 6C:
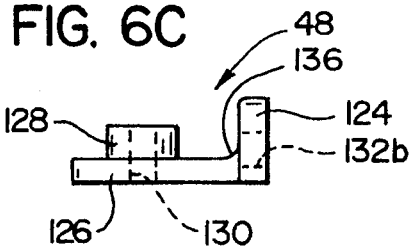
FIG. 6C is a side view of the door bracket of FIGS. 6A–6B.

As can be seen in FIG. 6B, the hub boss 118 forms a pivot attachment which is positioned in horizontal alignment between the bores 132*a*, 132*b* which are provided for the door attachment screws 64 (see FIG. 1). As was noted above, this configuration is important in that it eliminates any bending or prying moment, such as would result from positioning the pivot attachment either above or below the line of the fasteners. Moreover, by positioning the pivot point in line with the screw holes, the vertical height of the bracket is kept to a minimum. As was also discussed above, this is important if the device is to be used with a cabinet which has panelled doors: by positioning the screws near the bottom edge of the door, the bracket 48 ensures that these will engage the relatively thick material which forms the perimeter frame of the door, whereas if they were to be positioned much above this, the screws would tend to penetrate the thin (typically veneer) central panel and protrude through the outer surface thereof.

In the exemplary embodiment which is illustrated, the plate portion of the door bracket is approximately 1¾ inches long, with the screw holes 122*a*, 122*b* being spaced apart on 1⅜ inch centers. The tongue portion, in turn, extends outwardly to position the center of the hub boss approximately ⅝ inch from the surface of the door, with the boss itself having an external diameter of approximately 0.276 inches; for use with a ⅛ inch thick aluminum drawbar, such as that described above, a height 0.135 inches has been found suitable. In order to provide the increased strength and durability, the two side edges 134*a*, 134*b* of the tongue portion taper outwardly from the base thereof, for example, at an angle of about 10° from perpendicular to the base plate; moreover, the joint between the tongue and the base plate is provided with gusseting in the area indicated at 136.

It should be noted that the relationship of (a) the distance by which the hub boss 128 is positioned forwardly of the base plate, to (b) the spacing of the screw holes 132, is preferably selected so that the angle from the hub boss to the screw hole is such that the drawbar will strike the surface of the cabinet door before hitting the head of a screw. This is important inasmuch as it prevents the drawbar from acting as a lever which would tend to pry the bracket off the door.

d. Channel Members

Figure 7:
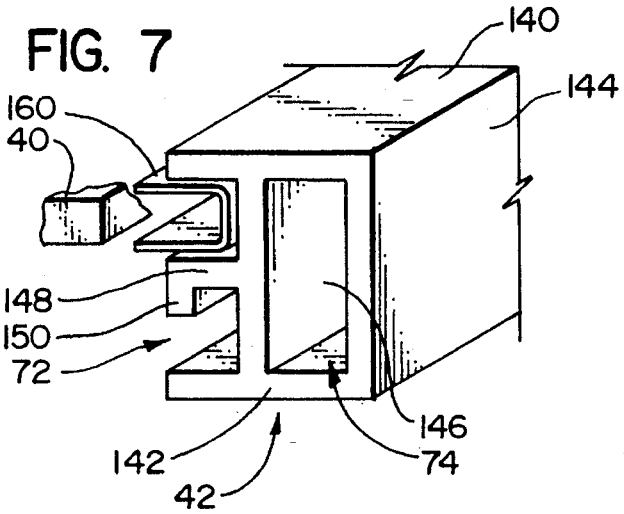
FIG. 7 is a perspective view of an end portion of a guide channel member of the assembly of FIG. 1, showing the construction which enables this to be used with panels of first and second thicknesses, and also enables this to be economically produced by an extrusion moulding process.
Figure 8A:
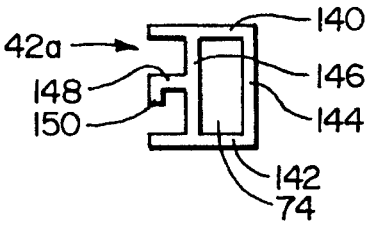
FIGS. 8A and 8B are end views of first and second guide channel members similar to that shown in FIG. 7 and having relatively narrower and wider widths.
Figure 8B:
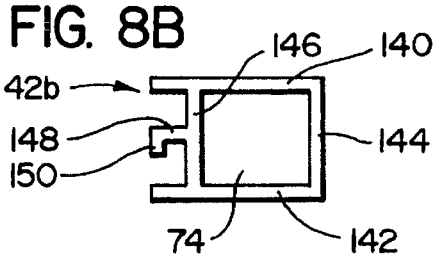

FIG. 7 illustrates the end portion of one of the two channel members.

As can be seen, the channel member is a hollow core structure formed of upper and lower horizontal wall portions 140, 142, and a vertical sidewall portion 144 which joins the former along one edge. A second vertical wall portion 146 extends down the middle of the member so as to define the hollow core 74 on one side, and a laterally extending channel opening on the other.

A divider wall 148 extends perpendicularly from the central vertical wall and parallel to the upper lower wall portions 140, 142, so as to divide the channel opening into the upper and lower slots 70, 72; a depending flange portion 150 is formed on the outer end of the divider wall, so that the divider and the upper wall define a slot having a first width, and the end of the flange and the lower wall form a slot having a second, narrower width. Also, as can be seen in FIG. 1, the channel members are preferably provided with pre-drilled holes for mounting screws 152.

The construction described above provides several significant advantages. Firstly, by providing slots having first and second widths, the same channel member may be used with tray panels of two different thicknesses. For example, the HDPE sheet material from which the tray panel is preferably formed is commonly and economically available in ¼ inch and 3/16 inch thicknesses, either of which may be suitable depending on the size of the tray panel; accordingly, the slots 70, 72 may suitably be formed with corresponding widths of 9/32 inch and 7/32 inch. The slots will be of a depth which is sufficient to engage and support the edge of the tray panel without danger of the latter becoming jammed or dislodged in use; for example, a depth of ¼ inch has been found to be particularly suitable in this regard.

Secondly, the wall portions of the channel member are all equal in thickness (e.g., see the depending flange portion 150). This renders it feasible to produce this member in an economical manner by means of an extrusion-moulding process, using material such as rigid PVC, whereas unequal-thickness walls or portions would result in unequal pressures and uneven extrusion rates at the die. For example, as part of the present invention, it was found to be particularly advantageous to make all of the wall portions approximately 0.100" thick when using rigid PVC, inasmuch as this was found to provide (1) smooth, uniform flow throughout the wall cross section, (2) relatively quick set times (and therefore higher production rates and superior quality control), and (3) an optimized balance between the volume of material used and the strength of the resulting structure.

Figure 3D:
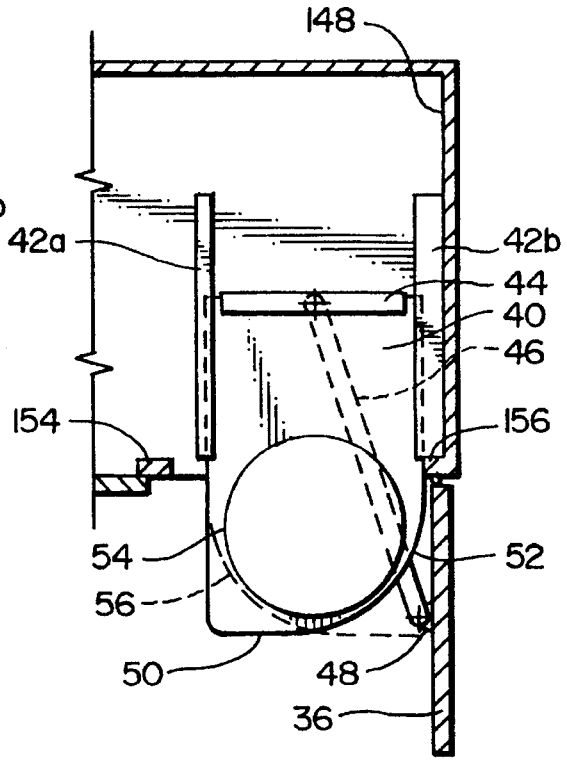
FIG. 3D is a view similar to FIGS. 3B–3C, showing the assembly with the door opened to a 90° angle.

Moreover, as can be seen in FIG. 1 and also in FIGS. 8A–8D, the two channel members are preferably provided in first and second (i.e., relatively narrower and wider) widths. For example, channel members **42*a*, 42*b* constructed in accordance with the foregoing description and having a wall thickness of 0.100 inch may both be ⅞ inch high, and ¾ inch and 1¼ inch wide, respectively, although other sizes may be provided depending on the intended application. The advantage of this configuration is that it provides an added degree of flexibility in installation. In particular, the narrow and wide channel members 42*a*, 42*b* correspond to relatively narrower and wider cabinet space frames, i.e., the frame members 154, 156 which are shown in FIGS. 3B–3D; for example, the two widths described above correspond with two sizes of face frames which are commonly used in residential cabinets. Moreover, this (in combination with the radiused corner 50 of the tray panel) permits the outer edge of the channel member which is adjacent the hinge (e.g., channel member 42*b* in FIGS. 3B–3D) to be mounted flush against the inside wall 148 of the cabinet while the edge of the tray panel will still clear the frame (see FIG. 3D**), thus eliminating any gap between the cannel and wall which could collect dirt and garbage.

e. Installation

As was noted above, the present invention has dispensed with the need for a separate foundation panel to ensure correct spacing of the channel members, thus achieving significant material and cost savings. This is accomplished by means of temporary spacer elements, in the form of U-shaped elements 160 (such as small pieces or strips of cardboard) which fit over the edge of the tray panel 40 and are received in one or both of the slots 70, 72.

Thus, the first step is to mount one of the channel members (selected to have the proper width, as described above) to the floor of the cabinet, and preferably flush against the wall so that there is no gap between the two. The spacer elements 160 are then fitted over one edge of the tray panel, and then both edges of the panel are placed in the corresponding slots in the channel members. The members are pressed together to achieve a firm fit, and the second channel member is then mounted to the floor. The door bracket is attached to inside of the cabinet door with the latter open to the 90° position, and the installer then fully opens the door to slide the spacer elements out of the slot; this leave a gaps along the edges of the tray panel which are perfectly sized to enable the tray to slide smoothly through the slots without fear of misalignment, jamming, or disengagement.

Having thus provided a description of the invention in its preferred embodiments, it will be understood that many modifications thereto and variations thereon will be obvious to those skilled in the art without departing from the basic spirit thereof. Accordingly, the present invention is not to be limited except as by the appended claims.

What is claimed is:

1. A sliding tray assembly configured to be mounted in a cabinet having an outwardly opening door, said tray assembly comprising:

a tray panel having parallel side edges and a forward end with a first, relatively square corner and a second, rounded-off corner which is configured to clear an inside of a cabinet door;

first and second channel members mountable to a cabinet floor and having guide slots for receiving said edges of said panel;

a door bracket member which is mountable to an inside of said cabinet door;

an elongate drawbar having a forward end pivotally mountable to said door bracket member and a rearward end; and a combination backstop and pivot attachment member mounted to a rearward end of said tray panel, said combination member comprising:

a channel portion having upper and lower walls which define a horizontal slot for retaining said rearward edge of said tray panel;

upper and lower flange portions which extend outwardly from said walls so as to form upper and lower backstops along said rearward edge of said panel;

upper and lower receptacle portions formed in said walls of said channel portion and extending outwardly from said horizontal slot so as to form upper and lower pockets adjacent said panel for receiving said second end of said drawbar;

said upper and lower pockets being arranged in vertical alignment on opposite sides of said slot so that said tray panel is alternatively mountable in first and second positions in which, respectively, said rounded-off corner clears a cabinet door which opens in right-handed and left-handed directions, by inverting said panel and installing said second end of said drawbar in a selected one of said pockets which is positioned on a lower side of said panel; and a pivot pin which extends vertically through said receptacle portions and said end of said drawbar which is received in said selected one thereof so as to pivotally interconnect said drawbar and said rearward edge of said tray panel, so that said drawbar extends beneath said tray panel and slides said panel through said channel members and in and out of said cabinet in response to opening and closing of said door.

2. The tray assembly of claim 1, wherein said door bracket member comprises:

a horizontally extending plate portion for mounting to said inside of said cabinet door; and an outwardly extending tongue portion having a pivot attachment for said forward end of said drawbar.

3. The tray assembly of claim 2, wherein said door bracket member further comprises:

first and second bores for mounting screws proximate first and second ends of said horizontally extending plate portion, said pivot attachment on said tongue portion being positioned in horizontal alignment between said first and second bores so as to eliminate development of prying moments against said mounting screws, and so as to minimize vertical spacing between said drawbar and said mounting screws so that said screws will be positioned to penetrate a relatively thicker frame portion of a panelled door.

4. The tray assembly of claim 3, wherein said pivot attachment for said forward end of said drawbar comprises:

a vertically extending boss forming a hub for rotation of said forward end of said drawbar about a vertical axis, said boss having a cylindrical outer bearing surface for engaging a corresponding bore formed in said end of said drawbar.

5. The tray assembly of claim 4, wherein said door bracket member is formed of a material having a relatively slick surface which enhances said bearing surface on said boss.

6. The tray assembly of claim 5, wherein said material having said relatively slick surface is molded nylon.

7. The tray assembly of claim 4, wherein said vertically extending boss portion further comprises:

a vertically extending bore formed in a middle portion of said boss; and a screw received in said vertically extending bore, said screw having a head which is sized larger than said bore in said end of said drawbar so as to retain said drawbar in engagement with said boss.

8. The tray assembly of claim 4, wherein said first and second bores in said ends of said plate portion are spaced apart by a distance which is selected relative to a distance by which said hub is spaced outwardly from said plate portion such that said drawbar avoids striking heads of said mounting screws when said drawbar is in a fully extended position.

9. The tray assembly of claim 1, wherein said combination backstop and pivot attachment member is formed of a generally rigid plastic material.

10. The tray assembly of claim 9, wherein said combination backstop and pivot attachment member further comprises:

attachment areas formed proximate first and second ends of each wall of said channel portion for mounting to said rearward edge of said tray panel by nailing therethrough.

11. The tray assembly of claim 10, wherein each said attachment area comprises:

a blister area formed in said wall of said channel portion, so that said wall bows outwardly from said horizontal slot so as to form a cavity intermediate said tray panel and said blister area, said cavity being sized to accommodate deformation of said plastic material and said panel which results from said nailing without spreading said walls of said channel portion away from said tray panel.

12. The tray assembly of claim 11, wherein each said channel member comprises:

first and second closed-edge slots, said first and second slots having first and second thicknesses such that said slots are sized to receive tray panels having first and second thicknesses.

13. The tray assembly of claim 12, wherein each said channel member comprises:

parallel, horizontally extending upper and lower wall portions;

a vertically extending sidewall portion joining said upper and lower wall portions along a first edge thereof;

a vertically extending middle wall portion joining said upper and lower wall portions along a middle portion thereof, so that a hollow core of said channel member is formed on a first side of said middle wall portion and a horizontally extending channel is formed in an opposite side thereof intermediate outwardly extending edges of said upper and lower wall portions; and a divider wall portion extending horizontally from a central portion of said middle wall portion so as to divide said horizontally extending channel into said first and second guide slots, said divider wall portion having a depending flange portion which extends perpendicularly from a side thereof, so that said upper horizontal wall portion and said divider wall portion define said first guide slot having said first width, and said lower horizontal wall portion and an end of said depending flange portion define said second guide slot having said second width.

14. The tray assembly of claim 13, wherein each said wall portion of said channel member is approximately equal in width so as to facilitate manufacture of said channel member by a die-extrusion process.

15. The tray assembly of claim 1, further comprising:

temporary means for spacing said channel members apart by a predetermined distance which is greater than a width of said tray panel so as to establish a gap along said edges of said panel which permits said panel to slide smoothly in said guide slots.

16. The tray assembly of claim 15, wherein said temporary means for spacing said channel members apart comprises:

a spacer strip which is temporarily positioned in said slot in said first channel member, said strip having a selected thickness such that said strip establishes said gap by removal thereof following installation of said assembly with said channel members pressed together against said edges of said tray panel.

* * * * *